US005523550A

United States Patent [19]

Kimura

[11] Patent Number: 5,523,550

[45] Date of Patent: Jun. 4, 1996

[54] CAPACITIVE INDUCTION HEATING METHOD AND APPARATUS FOR THE PRODUCTION FOR INSTANT HOT WATER AND STEAM

[76] Inventor: Todd T. Kimura, 5940 N. Las Virgines Rd. Apt. 716, Calabasas, Calif. 91302

[21] Appl. No.: 422,134

[22] Filed: Apr. 13, 1995

Related U.S. Application Data

[63] Continuation-in-part of Ser. No. 9,315, Jan. 25, 1993, abandoned, which is a continuation-in-part of Ser. No. 817,925, Jan. 6, 1992, abandoned.

[51] Int. Cl.[6] ..... H05B 6/54; H05B 6/10

[52] U.S. Cl. ..... 219/772; 219/628; 219/630; 392/331

[58] Field of Search ..... 219/764, 772, 219/780, 628, 629, 630, 601; 392/331, 332, 338

[56] References Cited

U.S. PATENT DOCUMENTS

| | | | |
|---|---|---|---|
| 1,145,508 | 7/1915 | Perkins | 219/772 |
| 2,273,037 | 2/1942 | Hothersall | 219/629 |
| 2,404,336 | 7/1946 | Wicks . | |
| 2,494,716 | 1/1950 | McMahon et al. | 219/630 |
| 2,508,365 | 5/1950 | Bierwirth | 219/780 |
| 2,584,654 | 2/1952 | Alden . | |
| 2,761,940 | 9/1956 | Mann et al. | 219/772 |
| 2,907,957 | 10/1959 | Dewitz | 219/772 |
| 3,214,562 | 10/1965 | Sargeant | 219/772 |
| 3,596,034 | 7/1971 | Mekjean | 219/629 |
| 3,854,032 | 12/1974 | Cooper | 219/383 |
| 3,909,588 | 9/1975 | Walker et al. . | |
| 3,946,197 | 3/1976 | Williams . | |
| 3,949,646 | 4/1976 | Taylor | 91/461 |
| 3,983,359 | 9/1976 | Walker et al. . | |
| 4.029,937 | 6/1977 | Russell . | |
| 4,429,203 | 1/1984 | Ramer . | |
| 4,814,567 | 3/1989 | De Angelis et al. | 219/772 |
| 4,953,536 | 9/1990 | Israelsohn et al. . | |

FOREIGN PATENT DOCUMENTS

| | | |
|---|---|---|
| 211686 | 11/1957 | Australia . |
| 536366 | 4/1974 | U.S.S.R. . |

OTHER PUBLICATIONS

Bibliographic Data.

*Primary Examiner*—Philip H. Leung
*Attorney, Agent, or Firm*—Poms, Smith, Lande & Rose

[57] ABSTRACT

A water heater including a first electrode and a second electrode in spaced relation to the first electrode. The first an second electrodes define a fluid path and a capacitance therebetween. The heater may also include a first winding associated with the fluid path and a second winding in spaced relation to the first winding and associated with the fluid path. The first and second windings generate a magnetic field therebetween and across the fluid path.

18 Claims, 4 Drawing Sheets

CAPACITIVE INDUCTION HEATING METHOD AND APPARATUS FOR THE PRODUCTION FOR INSTANT HOT WATER AND STEAM

CROSS REFERENCE TO RELATED APPLICATIONS

The present application is a continuation-in-part of U.S. Pat. application Ser. No. 08/009,315, filed Jan. 25, 1993, now abandoned which is itself a continuation-in-part of U.S. patent application Ser. No. 07/817,925, filed Jan. 6, 1992, now abandoned. The specification of each application is incorporated herein by reference.

BACKGROUND OF THE INVENTION

1. Field of Invention

The present invention relates generally to a water heating apparatus and, more particularly, to a water heating apparatus that employs a capacitive induction system to heat water.

2. Description of the Related Art

There are primarily two types of water heaters in use today. The first type of water heater, often referred to as a resistive heating heater, includes one or more resistive heating elements that are emersed directly into the water to be heated. The heating elements heat up as current passes therethrough and the amount of heat generated by each element is related to the resistance of the metal used to form the element. The other type of water heater employs an indirect heat source, i.e. a heat source that is not in direct contact with the water. The heat source is often a gas flame. Conduction and convection within the water cause heat to be generated by electron and molecular movement.

There are a number of disadvantages associated with resistive heating heaters. For example, the resistance of the heating elements increases as their temperatures increase. The increased resistance reduces the amount of current that is conducted by the elements, thereby reducing the efficiency of the elements and increasing the cost of operating the heater. Another disadvantage relates to the fact that resistive heating elements are electrodes. Because they are in direct contact with the water, cavitation frequently occurs on the surface of the heating elements. Such cavitation damages and can eventual destroy the heating elements.

There are also a number of disadvantages common to both types of heaters. For example, in order to be capable of instantaneously providing hot running water at a constant temperature, both types of heaters must be provided with costly additional apparatus. Such additional apparatus includes prepatory devices for adding electrolytes to the water or reservoirs in which heated water is stored and maintained at a predetermined temperature. In addition to the fact that such pre-heating and storing wastes a tremendous amount of energy, the reservoirs themselves are bulky, occupy a considerable amount of space, are subject to corrosion and leakage, and are difficult to dispose of at the end of their useful life because of environmental concerns.

OBJECT AND SUMMARY OF THE INVENTION

The general object of the present invention is to provide an improved water heater which obviates, for practical purposes, the aforementioned problems in the art.

In particular, one object of the present invention is to provide an improved water heater which is capable of rapidly heating water to a desired temperature.

Another object of the present invention is to provide an improved water heater which is capable of instantaneously heating running water to a desired temperature.

Still another object of the present invention is to provide an improved water heater which is more efficient and, therefore, less inexpensive to operate than prior art water heaters.

A further object of the present invention is to provide an improved water heater which is capable of instantaneously providing hot running water without the use of a pre-heated water reservoir or other prepatory apparatus.

A still further object of the present invention is to provide an improved water heater which requires less maintenance than prior art water heaters.

In order to accomplish these and other objectives, the present invention employs capacitance and induction to heat flowing water. More particularly, the present invention may include first and second electrodes in spaced relation to one another so as to define a fluid path and a capacitance therebetween. The present invention may also include first and second windings associated with the fluid path and in spaced relation to one another. When current is supplied to the first winding, a magnetic field is generated between first and second windings and across the fluid path such that current is induced in the second winding.

The capacitive induction heating provided by the present invention is capable of producing instant hot running water and steam from tap water, as well as water at an ambient temperature from other sources, without the aforementioned electrolyte preparation devices and pre-heating reservoirs. Thus, the present invention produces hot water and steam in a manner that is faster and more efficient than the prior art. Also, because it does not require prepatory apparatus or a reservoir, the present invention is more compact, requires less maintenance and is easier to dispose of than the prior art.

The above described and many other features and attendant advantages of the present invention will become apparent as the invention becomes better understood by reference to the following detailed description when considered in conjunction with the accompanying drawings.

BRIEF DESCRIPTION OF THE DRAWINGS

Detailed description of preferred embodiments of the invention will be made with reference to the accompanying drawings.

DETAILED DESCRIPTION OF THE PREFERRED EMBODIMENTS

The following is a detailed description of the best presently known modes of carrying out the invention. This description is not to be taken in a limiting sense, but is made merely for the purpose of illustrating the general principles of the invention. The scope of the invention is defined by the appended claims.

Figure 1:
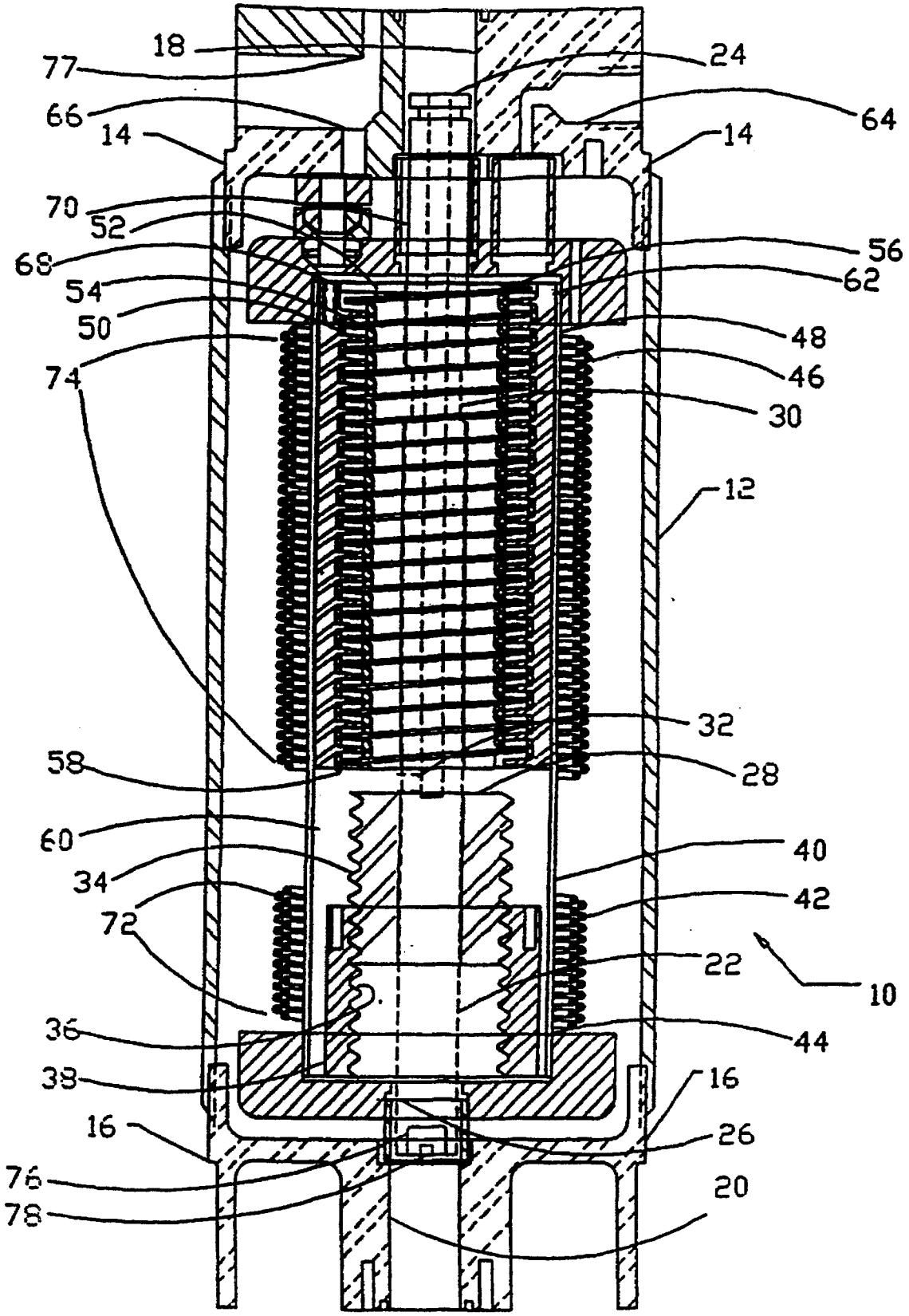
FIG. 1 is a section view of a water heater in accordance with a first preferred embodiment of the present invention.

Referring to the exemplary embodiment illustrated in FIG. 1, the present water heater (generally indicated by reference numeral 10) includes a hollow outer housing 12 having an upper closure member 14 and a lower closure member 16. The closure members include central apertures 18 and 20, respectively. One end 24 of a substantially cylindrical tubular shaft 22 is slidably mounted in central aperture 18. The other end 26 is mounted in a carriage member 28.

Tubular shaft 22 is at least partially composed of a ferromagnetic material which may extend from end 26 along approximately two-thirds of the total length of the tubular shaft. Tubular shaft 22 has a reduced diameter portion 30 and one or more openings 32. The openings may be spaced from end 26 by a distance equal to approximately one-third of the tubular shaft's total length. Carriage member 28 has a threaded outer surface 34 which mates with a threaded inner surface 36 of a lower mounting member 38. Lower mounting member 38 is, in turn, supported by lower closure member 16.

Water may be supplied to heater 10 from any suitable source. In accordance with the preferred embodiment illustrated in FIG. 1, water is delivered to the heater through end 24 of tubular shaft 22. The water flows out of the tubular shaft through opening(s) 32 and is contained in a first cylindrical member 40. First cylindrical member 40 extends between closure members 14 and 16 and is interposed between tubular shaft 22 and housing 12. The first cylindrical member is formed of an electrically insulating, nonporous material. Primary induction windings 42 are wound about an end 44 of first cylindrical member 40 and secondary induction windings 46 are wound about an opposite end 48. Cylindrical member 40 also carries a first electrode 50. First electrode 50 projects inwardly from first cylindrical member 40 and extends in a helical path along a substantial portion of the inner surface of the first cylindrical member.

Figure 4:
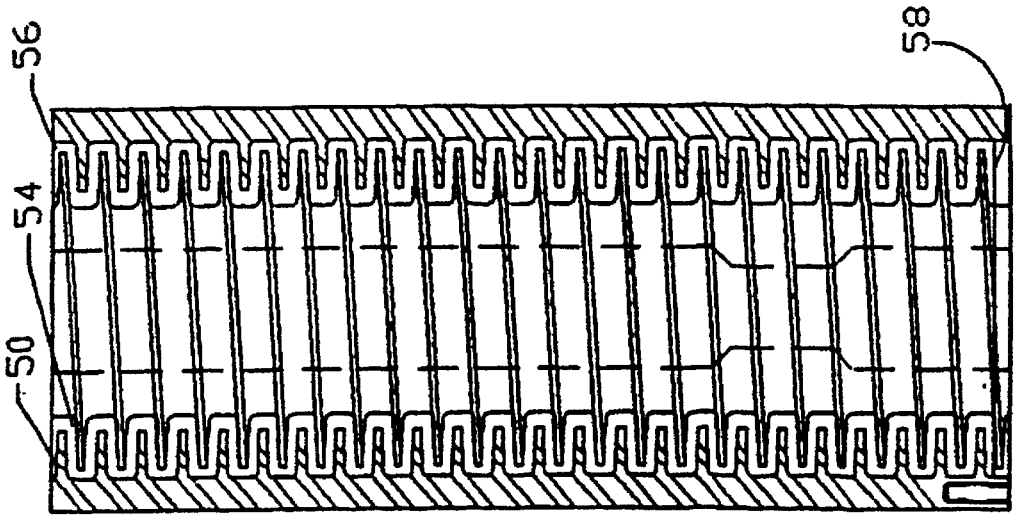
FIG. 4 is a partial section view showing the cylindrical members and electrodes illustrated in FIGS. 2 and 3 in an assembled orientation.
Figure 3:
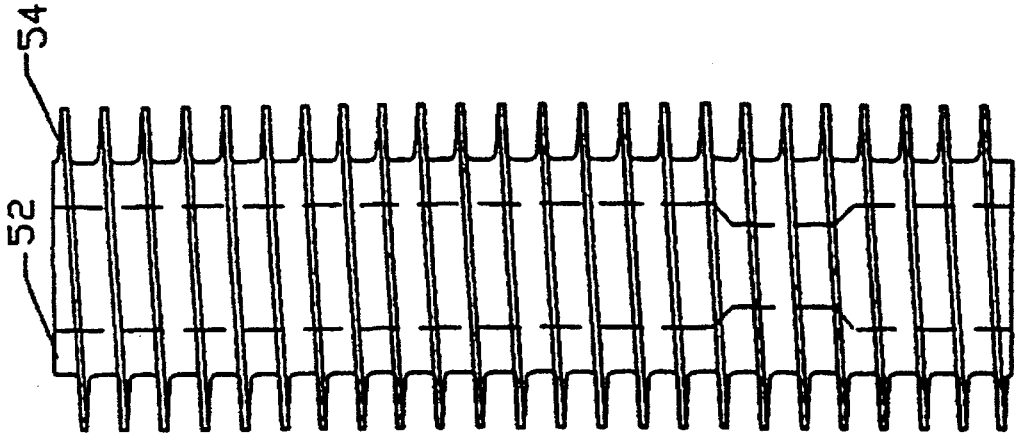
FIG. 3 is a front view of a second cylindrical member and second electrode in accordance with the preferred embodiment illustrated in FIG. 1.
Figure 2:
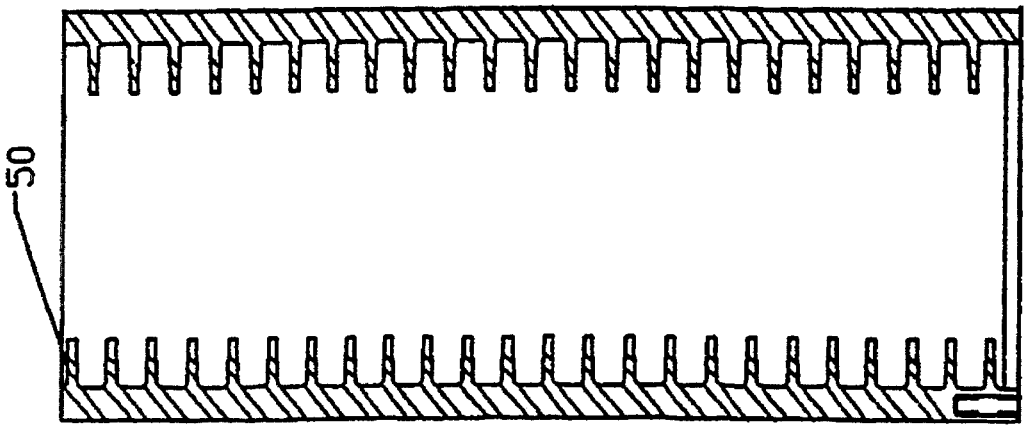
FIG. 2 is a section view of a first cylindrical member and first electrode in accordance with the preferred embodiment illustrated in FIG. 1.

As illustrated for example in FIGS. 1, 2 and 3, a second cylindrical member 52 is located adjacent to upper closure member 14. Second cylindrical member 52 is located between first cylindrical member 40 and tubular shaft 22 and carries a second electrode 54. Second electrode 54 projects outwardly from second cylindrical member 52 and extends in a helical path along its entire outer surface in spaced relation to first electrode 50. Accordingly, as best seen in FIG. 4, first electrode 50 and second electrode 54 define a helical channel 56 therebetween. The lower end 58 of helical channel 56 communicates with a chamber 60. Chamber 60 occupies the space between first cylindrical member 40 and tubular shaft 22. The upper end 62 of helical channel 56 is connected to a heated water outlet 64.

Referring to the exemplary embodiment shown in FIG. 1, alternating electric current may be supplied to heater 10 through an electrical inlet 66. The alternating current is connected to first electrode 50 through a contact 68 and to second electrode 54 through connection to second cylindrical member 52 at a contact 70. The capacitive circuit is completed at an electrical inlet 77 by a spring coil (not shown) contacting shaft end 24. Primary induction winding 42 is connected by wires 72 to a suitable electrical source (not shown) and wires 74 allow induced current to be carried away from secondary induction windings 46.

A rotatable engaging device 76 may be mounted on tubular shaft end 26. Engaging device 76 may be rotated by a key, a motor, or any other suitable device through a gear 78 to rotate tubular shaft 22. Such rotation causes carriage member 28 to travel upwardly or downwardly with respect to lower mounting member 38, thereby moving tubular shaft 22 with respect to secondary induction windings 46.

Figure 6:
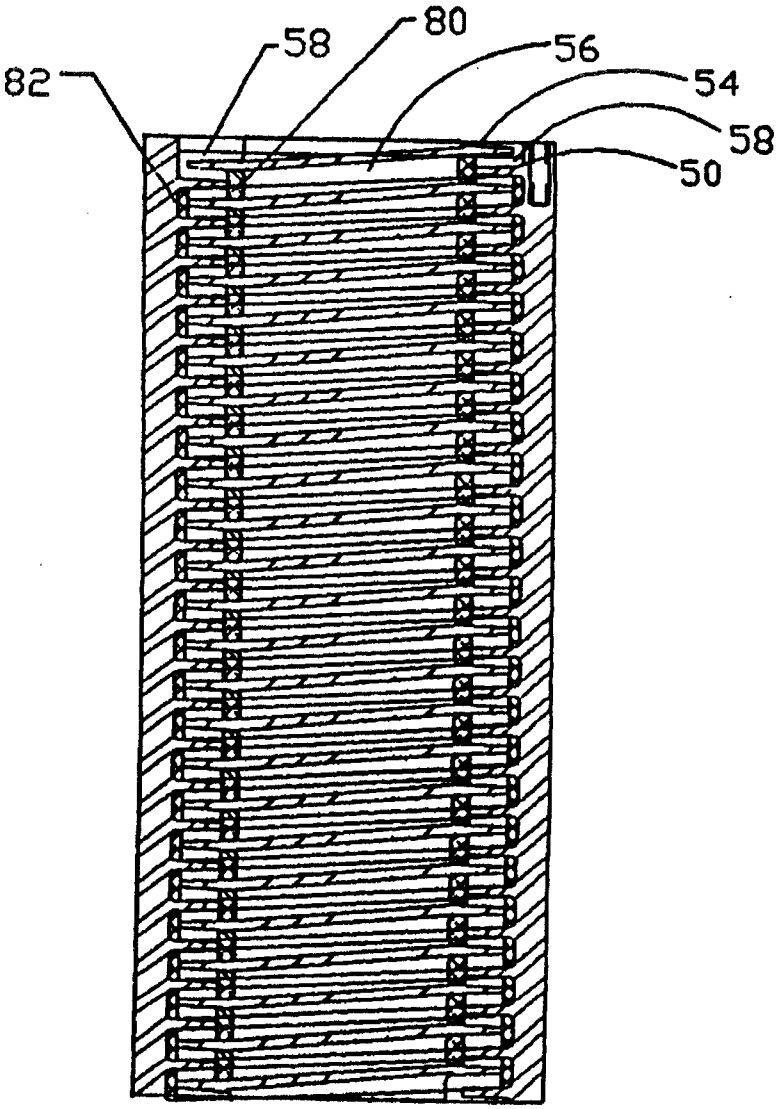
FIG. 6 is a section view showing the cylindrical members, electrodes and dielectric element illustrated in FIGS. 2–5 in an assembled orientation.
Figure 5:
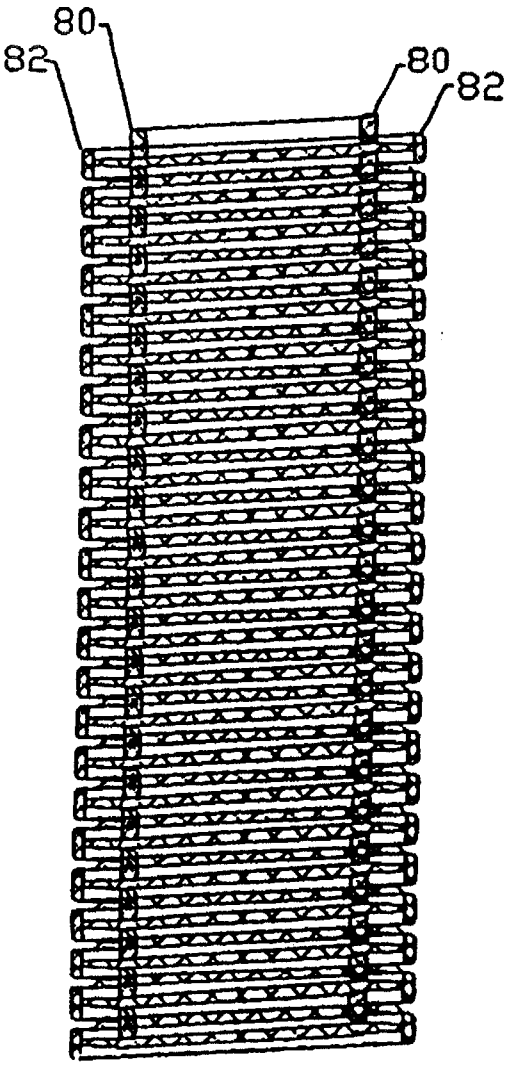
FIG. 5 is a section view of a dielectric element in accordance with the preferred embodiment illustrated in FIG. 1.

A pair of strip members 80 and 82, such as those shown by way of example in FIG. 5, may also be provided. The strip members are formed from a suitable dielectric material and, as shown in FIG. 6, may be helically wound for threaded insertion between first electrode 50 and second electrode 54. Strip members 80 and 82 enhance the capacitance between electrodes 50 and 54.

During a heating process, water travels through the first preferred embodiment in the following manner. First, water is delivered from a suitable source to opening 18. The water then passes into chamber 60 through tubular shaft 22 and opening(s) 32. Next, the water passes through lower end 58 of helical channel 56. The water eventually exits helical channel 56 through open end 62 and exits the heater through outlet 64.

While the water travels through water heater 10, electrical current is supplied through wires 72 to energize primary induction windings 42. As tubular shaft 22 is composed of ferromagnetic material, the primary induction windings create a magnetic field within the tubular shaft and the water flowing therethrough. The magnetic field agitates the water molecules, which in turn heats the water. In addition, tubular shaft 22 serves as a transformer core that causes the magnetic field produced by the primary induction windings 42 to induce an electric current in the secondary induction windings 46.

Alternating current is also supplied to first helical electrode 50 through contact 68 and to second helical electrode 54 through contact 70. Such current may be supplied by any suitable power source. Because the electrodes 50 and 54 are spaced apart, as best seen in FIG. 6, they form a capacitor across channel 56 and the water that flows through the channel. The capacitance between electrodes 50 and 54 tends to ionize the water and the frequency of the alternating current should be set such that polarity will be reversed before the water ions can begin to migrate toward one of the electrodes. The frequent polarity reversals cause the ions to vibrate (or agitate). Such vibration of the water ions flowing between electrodes 50 and 54 rapidly and efficiently heats the water.

In the embodiment illustrated in FIG. 1, the combination of capacitive and inductive heating heats the water flowing through channel 56 fast enough to convert the water to steam in a single pass through the channel. This capability greatly reduces the size and cost of the water heater. A reservoir is not required to store pre-heated water and the energy required to maintain the temperature of water is saved. Additionally, wires 74 may, if desired, be connected through electrical inlet 66 and contacts 68 and 70 to supply the alternating electrical current necessary to energize capacitive electrodes 50 and 54. So arranged, the electrical requirements of water heater 10 are reduced, as will the cost of operating the water heater.

In order to vary the rate at which the water is heated, gear 78 may be used to rotate tubular shaft 22 so that carriage member 28 will move the tubular shaft relative to secondary induction windings 46. Such movement varies the magnitude of the magnetic force transferred from primary induction windings 42 to secondary induction windings 46. The rate at which water flowing through channel 56 is heated will vary accordingly, as will the temperature of the water discharged through outlet 64. In the preferred embodiment illustrated in FIG. 1, full insertion of tubular shaft 22 into secondary induction windings 46 can, with proper current conditions, cause water flowing through channel 56 to be converted into steam in a single pass by the time it reaches outlet 64. Also, varying the electric current flowing through primary induction windings 42 will vary the electrical current that is induced in the secondary induction windings 46 and which flows through wires 74.

Figure 7:
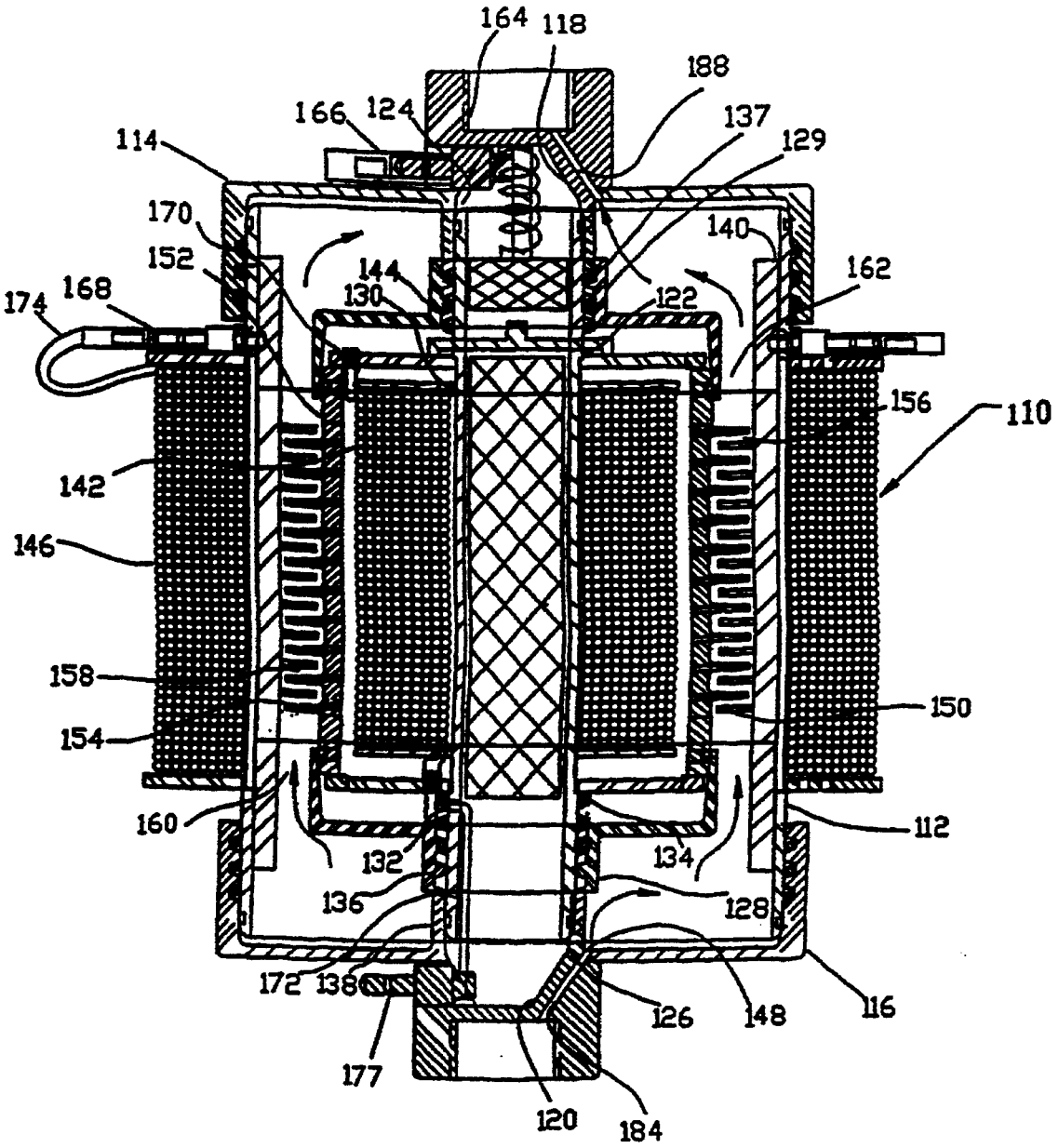
FIG. 7 is a section view of a water heater in accordance with a second preferred embodiment of the present invention.

A second preferred embodiment, generally indicated by reference numeral 110, is shown by way of example in FIG. 7. This embodiment differs from the exemplary illustrated in FIG. 1 in two significant respects. First, water enters heater 110 at its lower end and passes directly into the chamber adjacent to the inlet of the electrode channel. Second, the primary and secondary windings are concentric, as opposed to being axially spaced as they are in the embodiment shown in FIG. 1.

The second preferred embodiment includes an outer housing 112 having an upper closure member 114 and a lower closure member 116. The closure members include central apertures 118 and 120, respectively. One end 124 of a substantially cylindrical tubular shaft 122 is mounted in central aperture 118. The other end 126 is mounted in a carriage member 128. A similar carriage member 129 is located adjacent central aperture 118.

A ferromagnetic core 130 is interposed within tubular shaft 122. The tubular shaft also includes an opening 132 and threaded outer surfaces 134 and 144 at ends 126 and 124, respectively. Carriage members 128 and 129 have threaded inner surfaces 136 and 137 which mate with the threaded outer surfaces of the tubular shaft. A lower mounting member 138, which supports carriage member 128, is provided on lower closure member 116.

Water may be supplied to heater 110 from any suitable source. In accordance with the preferred embodiment illustrated in FIG. 7, water is delivered to the heater through central aperture 120 and flows through an inlet 184 into a chamber 160.

Primary induction windings 142 are wound about tubular shaft 122 and secondary induction windings 146 are wound about outer housing 112. A first cylindrical member 140 extends between closure members 114 and 116 and is formed of an electrically insulating, non-porous material. First cylindrical member 140 also carries a first electrode 150. First electrode 150 projects inwardly from first cylindrical member 140 and extends in a helical path along a substantial portion of the inner surface of the first cylindrical member. A second cylindrical member 152 is mounted between carriages 128 and 129 and is located between first cylindrical member 140 and primary induction windings 142. Second cylindrical member 152 carries a second electrode 154. Second electrode 154 projects outwardly from second cylindrical member 152 and extends in a helical path along a substantial portion of the second cylindrical member's outer surface in spaced relation to first electrode 150. Accordingly, first electrode 150 and second electrode 154 define a helical channel 156 therebetween. The lower end 158 of helical channel 156 communicates with chamber 160. The upper end 162 communicates with an aperture 188 that is connected to a heated water outlet 164.

As shown by way of example in FIG. 7, alternating electric current may be supplied to heater 110 through an electrical inlet 166. The alternating current is connected to second electrode 154 by a contact 170 and to first electrode 150 through connection to secondary induction windings 146 at contact 168. Wires 174 allow induced current to be carried from secondary induction windings 146 to contact 168. An electrical inlet 177, which may be connected to a suitable electrical source, is connected to primary induction windings 142 by wires 172 which extend through opening 132.

During the heating process, water is delivered to aperture 120, passes through aperture 184 into chamber 160, and then into the lower end 158 of channel 156. The water exits the open end 162 of the channel and then passes through an aperture 188 into outlet 164. While the water travels through water heater 110, electrical current is supplied through wires 172 to energize primary induction windings 142. A magnetic field is created between the primary and secondary induction windings which agitates the water molecules and heats the water. In addition, an electric current is induced in secondary induction windings 146.

Alternating current is also supplied to first helical electrode 150 through contact 168 and to second helical electrode 154 through contact 170. Because the electrodes 150 and 154 are spaced apart, they form a capacitor across channel 156 and the water that flows through the channel and the capacitance between electrodes 150 and 154 tends to ionize the water. The frequency of the alternating current should be set such that the polarity will be reversed before the water ions can begin to migrate toward one of the electrodes. The frequent polarity reversals cause the ions to agitate (or vibrate). The agitation of water ions flowing between electrodes 150 and 154 also adds heat to the water. The combination of such inductive and capacitive heating rapidly heats the water.

Although the present invention has been described in terms of the preferred embodiment above, numerous modifications and/or additions to the above-described preferred embodiments would be readily apparent to one skilled in the art.

For example, multiple heating units may be connected in series, in a manner resembling a multi-cylinder engine, with the second heating unit drawing electrical current from wires 74 of the first heating unit, the wires 74 of the second heating unit supplying electric current to the third heating unit, etc. Additionally, the electrodes do not have to be shaped such that helical channels are formed. The helical electrode arrangement may, for example, be replaced by an arrangement wherein rod electrodes are placed in an ion chamber to generate sparks therebetween. Water passing therethrough will be ionized. It should also be noted that the present invention is not limited to use with water but may be used to heat other fluids.

It is intended that the scope of the present invention extends to all such modifications and/or additions and that the scope of the present invention is limited solely by the claims set forth below.

I claim:

1. A water heater, comprising:

a first electrode defining a substantially helical shape;

a second electrode defining a substantially helical shape, the first and second electrodes being located substantially adjacent one another and defining a substantially helical channel therebetween; and current means for supplying alternating electric current to the first and second electrodes to form a capacitance between the electrodes and across the channel.

2. A water heater as claimed in claim 1, further comprising:

a housing substantially enclosing the first and second electrodes;

a primary inductance winding arranged on a first portion of the housing; and a secondary inductance winding arranged on a second portion of the housing, the second portion being longitudinally spaced from the first portion.

3. A water heater as claimed in claim 2, wherein the second electrode defines a longitudinal axis, the heater further comprising:

a tubular shaft arranged substantially along the longitudinal axis of the second electrode, the tubular shaft extending through the primary inductance winding and the secondary inductance winding.

4. A water heater as claimed in claim 3, further comprising:

means for moving the tubular shaft relative to the secondary winding.

5. A water heater as claimed in claim 3, wherein the tubular shaft is composed of a ferromagnetic material.

6. A water heater as claimed in claim 2, wherein the secondary winding is electrically connected to the first and second electrodes.

7. A water heater as claimed in claim 1, further comprising:

a dielectric strip disposed substantially between the first and second electrodes.

8. A water heater, comprising:

a first electrode;

a second electrode substantially adjacent to the first electrode, the first and second electrodes defining a fluid path and a capacitance therebetween;

a first winding substantially surrounded by the fluid path; and a second winding in spaced relation to the first winding and substantially surrounding the fluid path, the first and second windings generating a magnetic field therebetween and across the fluid path.

9. A water heater as claimed in claim 8, further comprising:

at least one current source operably connected to the first and second electrodes.

10. A water heater as claimed in claim 9, wherein the at least one current source comprises at least one alternating current source.

11. A water heater as claimed in claim 8, further comprising:

a dielectric strip disposed substantially between the first and second electrodes.

12. A water heater as claimed in claim 8, wherein the first winding defines a first space and the second winding defines a second space, the heater further comprising:

a tubular shaft arranged substantially within the first and second spaces.

13. A water heater as claimed in claim 12, wherein the tubular shaft is composed of a ferromagnetic material.

14. A water heater as claimed in claim 12, further comprising:

means for moving the tubular shaft within the first and second spaces.

15. A method of heating fluid, comprising the steps of:

providing a fluid path;

directing water through the fluid path;

applying a capacitance to the fluid as it flows through the fluid path;

providing first and second windings in spaced relation to one another, the first winding being substantially surrounded by the fluid path and the second winding substantially surrounding the fluid path; and applying an electrical current to one of the first and second windings such that electrical current is induced in the other winding.

16. A method as claimed in claim 15, wherein the step of providing a fluid path comprises the step of providing fluid path having at least a portion defining a substantially helical shape.

17. A method as claimed in claim 15, wherein the step of applying an electrical field comprises the step of applying a magnetic field.

18. A method as claimed in claim 15, wherein the step of applying a capacitance comprises the step of applying a capacitance having a periodically alternating polarity.

* * * * *